US006367392B2

(12) United States Patent
Moore

(10) Patent No.: US 6,367,392 B2
(45) **Date of Patent: *Apr. 9, 2002**

(54) CUSTOMIZED TABLE TOPS

(76) Inventor: William Moore, 3804 Landstrom Rd., Rockford, IL (US) 61114

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/343,811

(22) Filed: Jun. 30, 1999

Related U.S. Application Data

(60) Provisional application No. 60/091,423, filed on Jul. 10, 1998.

(51) Int. Cl.[7] ..... A47B 13/08
(52) U.S. Cl. ..... 108/90; 108/27
(58) Field of Search ..... 108/27, 90, 153.1, 108/59

(56) References Cited

U.S. PATENT DOCUMENTS 3,554,140 A * 1/1971 Homesbereger ..... 108/90
4,821,651 A * 4/1989 Peng ..... 108/90
4,905,611 A * 3/1990 Jung-chung ..... 108/90
5,404,828 A * 4/1995 Tesney ..... 108/27
5,600,911 A * 2/1997 Lucci ..... 108/90 X
5,634,411 A * 6/1997 Chasan ..... 108/27 X
5,697,305 A * 12/1997 Chasan et al. ..... 108/27 X
5,830,552 A * 11/1998 Meier et al. ..... 108/27 X

* cited by examiner

*Primary Examiner*—Jose V. Chen
(74) *Attorney, Agent, or Firm*—Michael Best & Friedrich LLC

(57) ABSTRACT

A table top having a transparent cover through which inserts, such as advertisements, etc. can be viewed. The table top is configured for affixation to a base. The table top comprises a frame having sides, an underlay and a transparent cover. A cavity is formed in the base and is defined by the frame and base. The underlay and transparent cover are substantially planar and are configured to fit within the frame adjacent to each other. The insert is configured to be held between the cover and underlay such that one side of the insert is viewable through the cover.

20 Claims, 2 Drawing Sheets

CUSTOMIZED TABLE TOPS

This Appln claims benefits of Prov. No. 60/091,423 filed Jul. 10, 1998.

FIELD OF THE INVENTION

This invention relates to furniture and, more particularly, to customized table tops intended primarily for commercial use.

BACKGROUND OF THE INVENTION

Commercial establishments, such as restaurants, food courts and the like, often use tables with tops or surface that in some way display menus, print advertising or some other promotional or commercial information. This commercial information may be permanently affixed to the table top by, for example, being placed underneath a transparent cover. Preferably, however, the commercial information should be easy to change and replace.

Another desirable feature of any table design is the ability to customize the table to a particular buyer's needs and whims. The table design elements which buyers may wish to vary include the size and configuration of the table, the materials used, the number of table legs and the appearance and shape of the table top. Buyers of tables with transparent tops may wish to customize the appearance, design and/or shape of the surface trim.

The tables which are currently available that have transparent tops and replaceable commercial information typically comprise a plain table surface covered by the menu(s), advertising or other commercial information contained on paper-thin sheets. A transparent, usually glass, cover of a size and configuration corresponding to that of the table surface is then placed on top of the table surface. One problem with this construction, however, is that positioning the glass cover to fit exactly on top of the table surface can be cumbersome and may disturb the placement of the commercial information unless the sheets displaying such information are somehow affixed to the table surface. Moreover, once in place, the glass cover is not secured to the table surface except by the forces of gravity and friction. As a result, the cover could easily slide around or be bumped out of place by someone sitting at the table or by a passerby.

U.S. Pat. No. 4,841,848 granted on Jun. 27, 1989 to Elliot Kriegsman discloses one type of table which has an appearance changeable top. This patent discloses a table having a table top, a plurality of legs positioned at the corners of the table top, a cover with depending sides that fits over the table top and an insert that is placed between the table top and the cover. However, the tables disclosed in this patent have certain structural limitations: for instance, they are supported by a plurality of legs and their shape is limited to a substantially rectangular configuration. Moreover, because the cover described in the invention is made of a clear material, the table top surface cannot be designed with a customized trim or border.

Accordingly, it is an object of this invention to provide an improved table top for commercial use having inserts that may be easily replaced.

It is another object of this invention to provide an improved table top for commercial use having a cover that is easily positioned and removed, and that securely holds the insert in place.

A further object of this invention is to provide an improved table top for commercial use having a trim or border that may be custom designed to suit a particular buyer's tastes.

Yet another object of this invention is to provide an improved table top for commercial use that may be designed and constructed in nearly any shape or configuration.

A further object of this invention is to provide an improved table top for commercial use that is capable of being supported on a single leg or a plurality of legs.

SUMMARY OF THE INVENTION

The present invention accomplishes the foregoing objectives by providing a table top with a frame to which a base is attached, and a cavity formed by the base and the sides of the frame. The appearance and design of the frame may be customized to meet the specifications of the particular buyer. The depth of the cavity may be adjusted by increasing or decreasing the height of the sides of the frame. An underlay and a transparent cover may be placed in the cavity. Menus, print advertising or other media displaying promotional or commercial information are placed between the underlay and the cover. Additionally, a light source may be disposed in the cavity to illuminate the commercial information. Finally, the cavity may contain an electronic display featuring menus, advertisements, full motion video advertisements or other commercial information.

DESCRIPTION OF THE PREFERRED EMBODIMENTS

Figure 2:
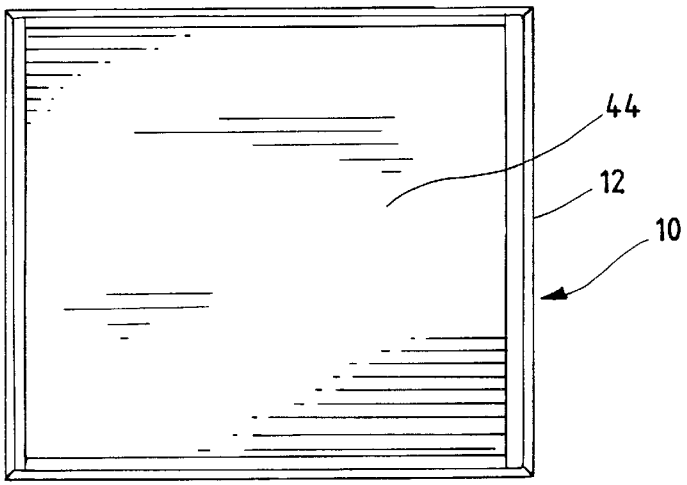
FIG. 2 is a bottom plan view of the table top of FIG. 1.

Referring now to FIGS. 1–5, a preferred embodiment of the table top in accordance with the present invention is generally designated at reference numeral 10. Table top 10 comprises a frame 12 to which base 14 of the table is attached. A cavity 16 is defined by the base of the table and the sides of frame 12. An underlay 18 may be placed on top of base 14 and may be covered by transparent cover 20.

Figure 1:
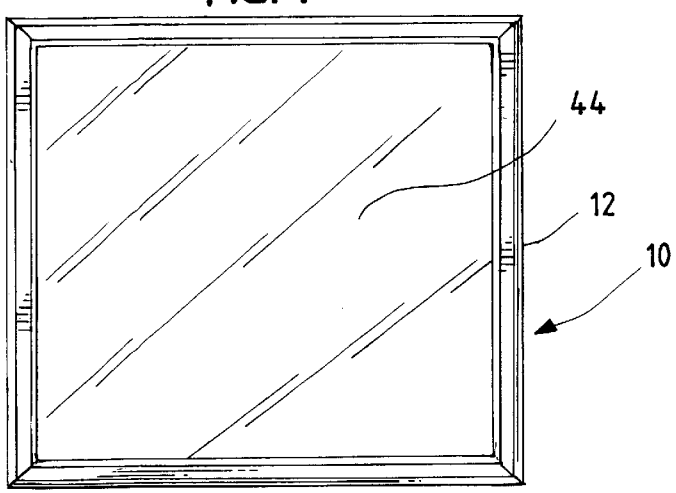
FIG. 1 is a top plan view of a table top according to the present invention.

Table top 10, as depicted in FIGS. 1 and 2, is formed as a square, having frame 12 comprising four sides of equal lengths. However, the table top of the present invention may be made in any configuration, as long as the frame is capable of supporting a wall, a top ledge and a bottom ledge, as described more fully below.

Moreover, table top 10 depicted in FIGS. 1 and 2 has a relatively thin frame which makes up a very small percentage of the table top surface. The frame, however, can be made as thin or as wide as the user desires.

Frame 12 comprises wall 22, top ledge 24 and bottom ledge 26. Wall 22 comprises two parallel sides, an inner side 28 and an outer side 30, and two opposed surfaces, top surface 32 and bottom surface 34. Top ledge 24 and bottom ledge 26 are secured to inner surface 28 by any suitable means; the preferred method, however, is by an adhesive, such as glue. As is conventional in the art of table manufacture, top ledge 24 is permanently secured to wall 22 of frame 12 so that the exposed surface 36 of top ledge 24 and top surface 32 of wall 22 form a smooth, continuous and planar surface. Similarly, bottom ledge 26 is permanently secured to wall 22 so that undersurface 40 is coplanar with bottom surface 34 of wall 22.

Figure 4:
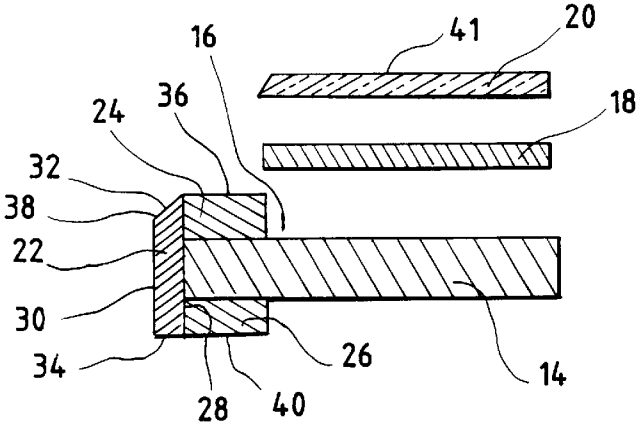
FIG. 4 is an exploded cross-sectional view of the table top of FIG. 1 positioned for assembly.
Figure 3:
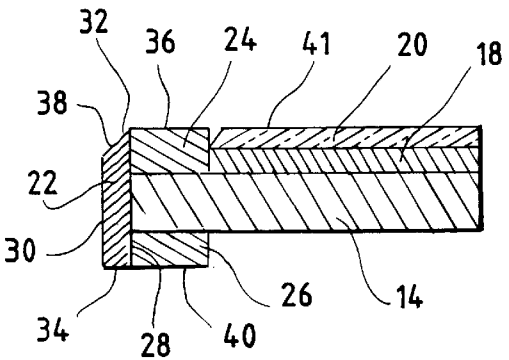
FIG. 3 is a cross-sectional view of the table top of FIG. 1.
Figure 5:
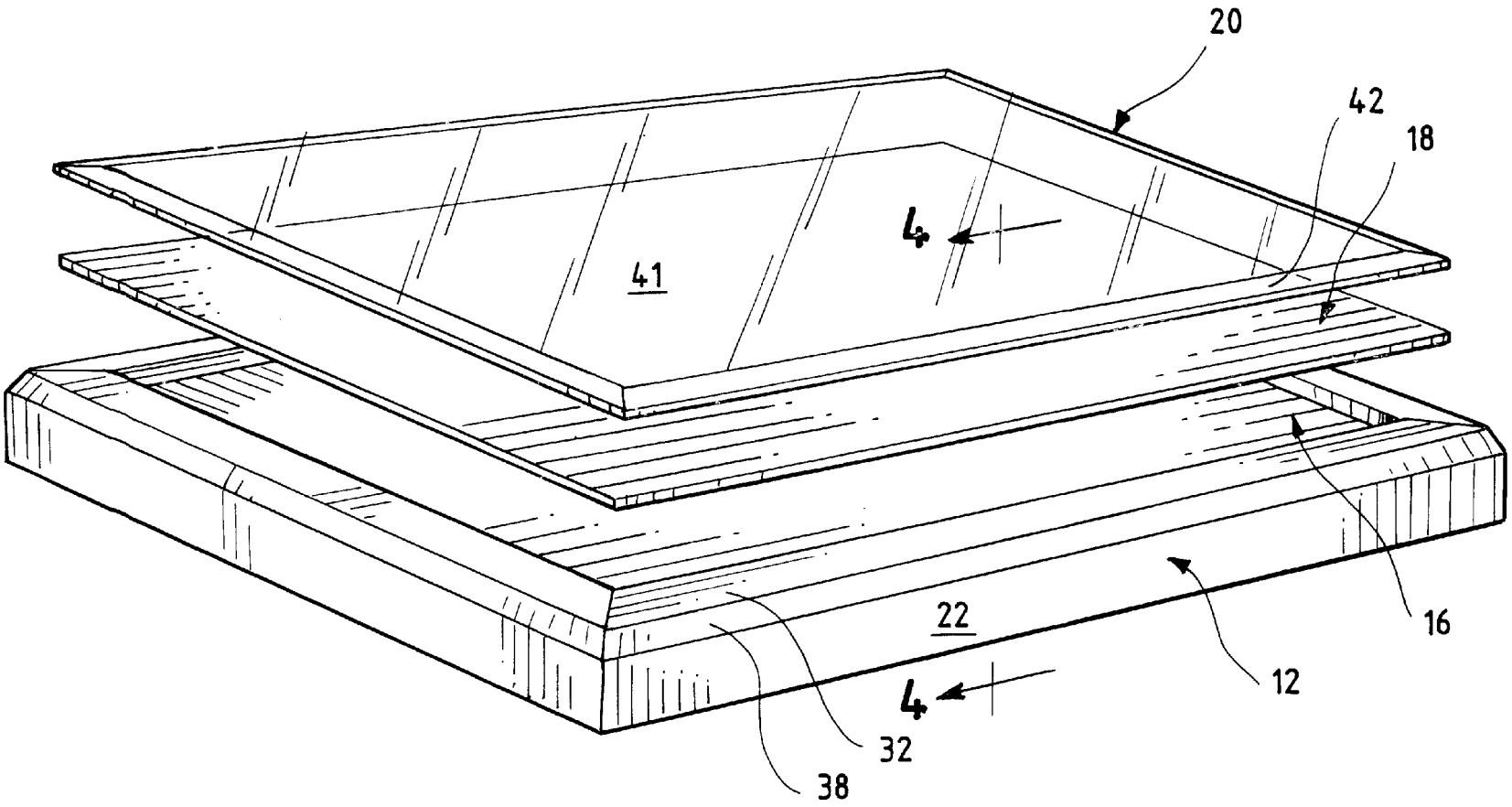
FIG 5 is a an exploded perspective view of the table top of FIG. 1 positioned for assembly.

Preferably, as best seen in FIGS. 3–5, top surface 32 and outer side 30 of wall 22 form a beveled edge 38. Beveled edge 38 creates an aesthetically more pleasing appearance for table top 10; in addition, by eliminating the usual sharp edges of a table top, the use of beveled edges minimizes the risk that the user or passerby will inadvertently injure himself.

Base 14 of table top 12 is placed between top ledge 24 and bottom ledge 26 and secured to inner surface 28 of wall 22 by an adhesive, preferably glue, as is standard practice in manufacturing tables.

Preferably, wall 22 is made of Formica; alternatively, the wall may be made of oak, corian or some other type of wood which would be more expensive to use but which would render an elegant, sophisticated appearance. Top and bottom ledges 24 and 26 respectively could be made of wood, which can be painted or otherwise treated in order to match the appearance of wall 22, so that entire frame 12, or at least the portions exposed to view, have a uniform appearance. However, as described above, the appearance and design of frame 12 can be custom-made according to very specific instructions and details provided by the user.

Top ledge 24 and base 14 of table top 10 meet to form a cavity 16, the depth of which depends on the height of top ledge 24 and, accordingly, the height of wall 22 to which top ledge 24 is secured. Thus, cavity 16 may be made deeper or more shallow simply by increasing or decreasing the height of top ledge 24 and the height of wall 22.

Underlay 18 is planar and is formed of a size and configuration to fit into cavity 16 and on top of base 14. Underlay 18 is preferably made of wood particle board or other material that provides a rigid and sturdy support but is relatively inexpensive. The use of underlay 18 is conventional in the art of table manufacture; however, table top 10 could also be manufactured in accordance with the present invention without underlay 18. Cover 20 is also planar, and is similarly formed of a size and configuration to fit into cavity 16 and on top of underlay 18. The preferred material for cover 20 is glass; however, any other clear, transparent material, such as clear plastic, would also be suitable. Cover 20 comprises an exposed upper surface 41 with upper edges 42 which may be beveled, as best seen in FIG. 5. Beveled edges 42 facilitate locating and placing cover 20 in frame 12 and extricating cover 20 from frame 12 because they allow the cover to more easily slide into place. However, upper edges 42 may also comprise right angles.

The embodiments depicted in FIGS. 1–5 represent one embodiment of table top 10 of the present invention. In this embodiment, a paper-thin insert (not depicted in the Figures) is placed between the underlay and the glass cover. This insert may be provided with an upper surface which displays a singular print advertisement, a series of print advertisements, a menu, or other commercial information that is capable of being printed or reproduced on a piece of paper, a sheet-like piece of cardboard or the like. The insert is also formed of a size and configuration to fit into the cavity 16, on top of underlay 18 and beneath cover 20. In this way, the insert can be viewed through transparent cover 20 by an individual sitting at the table. Transparent cover 20 also securely holds the insert in place and protects the insert from being soiled, torn or otherwise destroyed.

In the above described embodiment of table top 10, the features described above have the following preferred heights: wall 22 has a height of 1¾", top ledge 24 and bottom ledge 26 are both ½" high; and base 14 is ¾" high. Both underlay 18 and transparent cover 20 have preferred heights of ¼". These dimensions only apply to the preferred embodiment described above. The dimensions may be altered to suit the user's taste. It is apparent to those skilled in the art that modifications may be made without departing from the spirit and scope of the invention as described above. Accordingly, the invention is not meant to be limited by recitation of specific dimensions.

In one preferred embodiment, apertures are disposed at the center of cover 10, underlay 18 and base 14. The location and dimensions of these apertures are identical so that when base 14, underlay 18 and cover 20 are properly positioned, the apertures formed in each element directly line up with each other. As a result, the apertures form a bore 44 that extends from cover 20 and terminates at base 14, as best seen in FIGS. 1 and 2. Bore 44 is dimensioned to receive a bolt (not shown). When positioned in place in bore 44, the head of the bolt protrudes from the top of cover 20 and the opposite end of the bolt emerges from beneath base 14. The head of the bolt may serve as a base to which a napkin holder, advertisement holder and the like may be attached. The bolt is secured into place by means of a nut fastened onto the opposite end of the bolt that is exposed to view under base 14. This feature allows the table top user to easily reach underneath the table to unscrew the nut, and then disengage the bolt from bore 44. The user can then place his index finger or thumb in the aperture formed in the cover, thereby allowing the user to more easily lift cover 20 from frame 12 and out of cavity 16. The insert can them be removed and replaced with a new insert. Once a new insert is placed in cavity 16 and on top of underlay 18, the user may reposition cover 20 on top of the insert, once again placing the thumb or index finger in the aperture in cover 20 to assist in locating cover 20 into its proper place. Finally, the bolt is positioned in bore 44 and secured in place by fastening the nut on the bolt.

Other embodiments of the disclosed invention include "medium-tech" and "high-tech" versions of table top 10. To manufacture the medium- and high-tech versions, the height of top ledge 24, and accordingly the height of wall 22 to which it is attached, is typically increased in order to create a deeper cavity. Both the "medium-tech" and "high-tech" embodiments of the table top will be customized with respect to the electrical wiring, in order to accommodate the particular limitations, needs and objectives of the user.

In the "medium-tech" version of the table top, the heights of top ledge 24 and wall 22 of the frame are adjusted to create a cavity 16 that is preferably approximately 1 inch deep. A light source, preferably a series of small light bulbs such as white translucent bulbs, are disposed in underlay 18. The intensities of these light bulbs may be adjusted by means of a dimmer switch located underneath base 14 of the table or on a table leg. Alternatively, the light source could also be controlled by means of a centrally-located, master dimmer switch. The deeper cavity is needed in order to accommodate the dimensions of the light bulbs and to diffuse the light they emit. An insert containing advertising, a menu or other commercial information is placed on top of underlay 18. This insert is made of clear plastic or some other material which is translucent but which will not be destroyed or otherwise affected by the heat emitted by the light bulbs. Finally, cover 20 is placed in cavity 16 and on top of the insert. In this way, the lights will shine through the transparent insert and cover 20, thereby illuminating the information contained on the insert.

Finally, the high-tech embodiment of the table typically requires increasing the heights of top ledge 24 and wall 22 of frame 12 to form a cavity that is deep enough to accommodate an electronic display. Underlay 18 consists of the electronic display which is preferably about 2–3 inches thick, and cover 20 is placed directly on top of the electronic display. The electronic display may comprise a flat panel display, an LCD and the like. The electronic display is hooked up to a main server, allowing it to display menus, advertisements, including full motion video advertisements, or other commercial information with or without sound. Cover 20 can be made into a touch screen so that a person sitting at the table may order from the menu or otherwise interact with the commercial information displayed by the electronic display.

It will be apparent to those skilled in the art that modifications may be made without departing from the spirit and scope of the invention. Accordingly, it is not intended that the invention be limited except as may be necessary.

What is claimed is:

1. A table top for housing a display, the table top comprising:

a base having a top surface;

a frame having an inner edge, the frame being attached to the base to form an open cavity defined by the top surface of the base and said inner edge of said frame;

a substantially transparent cover shaped and sized to be dropped into and fit within said cavity such that said cover can be placed within and removed from said cavity without removing the frame from the base;

wherein the display can be housed in said cavity between said base and said cover such that the display is visible through said cover.

2. The table top of claim 1 wherein the cover has an outer edge and is configured to fit within the cavity such that outer edge of the cover is substantially flush with the inner edge of the frame.

3. The table top of claim 1, wherein the cover is substantially planar.

4. The table top of claim 3 wherein a display is stored within the open cavity and under the cover, and the frame has an upper surface, the cover has an upper surface, and the upper surface of the cover is substantially level with the upper surface of the frame when the cover is placed within the open cavity and over the display stored within the cavity.

5. The table top of claim 1 further comprising an underlay placed within the cavity and on the top surface of the base, wherein the display can be housed between the underlay and the cover.

6. The table top of claim 1, wherein the base has an outer edge and the frame comprises a wall having an inner surface, a top ledge protruding from the inner surface of the wall and a bottom ledge protruding from the inner surface of the wall below the top ledge, wherein the outer edge of the base is situated between the top ledge and the bottom ledge, and the top ledge defines the inner edge of the frame.

7. The table top of claim 1 further comprising a fastener and wherein the cover defines an aperture, the base defines an aperture, and the aperture of the cover and the aperture of the base are aligned to form a bore dimensioned to receive the fastener.

8. The table top of claim 7, wherein the fastener is a bolt.

9. A table top for housing a display, the table top comprising:

a base having a top surface and an outer edge;

a frame having an inner edge, the frame being attached to the base and forming a border adjacent the outer edge of the base;

an open cavity defined by the top surface of the base and the inner edge of the frame;

a substantially transparent cover having an outer edge and configured to fit within the cavity such that outer edge of the cover is substantially flush with the inner edge of the frame;

wherein the display can be housed in the cavity between the base and the cover such that the display is visible through the cover, and wherein the frame has an upper surface, the cover has an upper surface, and the upper surface of the cover is substantially level with the upper surface of the frame when the cover is placed within the open cavity and over the display housed in the cavity.

10. The table top of claim 9 wherein the cover is substantially planar.

11. The table top of claim 9 further comprising an underlay placed within the cavity and on the top surface of the base, wherein the display can be housed between the underlay and the cover.

12. The table top of claim 9 further comprising a fastener and wherein the cover defines an aperture, the base defines an aperture, and the aperture of the cover and the aperture of the base are aligned to form a bore dimensioned to receive the fastener.

13. The table top of claim 12, wherein the fastener is a bolt.

14. The table top of claim 9 wherein the cover is shaped and sized to be dropped into and fit within the open cavity such that the cover can be placed within and removed from the cavity without removing the frame from the base.

15. A table top for housing a display, the table top comprising:

a base having a top surface and an outer edge;

a frame comprising a wall having an upper surface and an inner surface, the frame being located on the top surface of the base and forming a border adjacent the outer edge of the base;

an open cavity defined by the top surface of the base and the inner surface of the frame, the open cavity being shaped and sized for housing the display;

a substantially transparent cover having an upper surface and an outer surface and configured to fit within the cavity such that outer surface of the cover is adjacent the inner surface of the frame and the upper surface of the cover is substantially level with the upper surface of the frame when the cover is placed within the open cavity and over the display housed within the cavity;

wherein the display can be housed in the cavity between the base and the cover such that the display is visible through the cover.

16. The table top of claim 15 wherein the cover is shaped and sized to be dropped into and fit within the open cavity such that the cover can be placed within and removed from the cavity without removing the frame from the base.

17. The table top of claim 15 further comprising an underlay placed within the cavity and on the top surface of the base, wherein the display can be housed between the underlay and the cover.

18. The table top of claim 15 further comprising a fastener and wherein the cover defines an aperture, and the aperture of the cover and the aperture of the base are aligned to form a bore dimensioned to receive the fastener.

19. The table top of claim 18 wherein the fastener is a bolt.

20. The table top of claim 15 wherein the frame comprises a wall.

* * * * *